US007673485B2

(12) United States Patent
Imai et al.

(10) Patent No.: US 7,673,485 B2
(45) Date of Patent: Mar. 9, 2010

(54) HOT PRESS FORMING METHOD

(75) Inventors: Kazuhito Imai, Amagasaki (JP); Tamotsu Toki, Nishinomiya (JP); Yukihiro Yoshikawa, Kyoto (JP); Masaru Takahashi, Amagasaki (JP); Toshinobu Nishibata, Amagasaki (JP); Nobusato Kojima, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/186,973

(22) Filed: Jul. 22, 2005

(65) Prior Publication Data

US 2005/0252262 A1 Nov. 17, 2005

Related U.S. Application Data

(60) Division of application No. 10/730,978, filed on Dec. 10, 2003, now abandoned, which is a continuation of application No. PCT/JP02/10972, filed on Oct. 23, 2002.

(30) Foreign Application Priority Data

| | | |
|---|---|---|
| Oct. 23, 2001 | (JP) | 2001-324572 |
| Oct. 23, 2001 | (JP) | 2001-324573 |
| Nov. 7, 2001 | (JP) | 2001-342151 |

(51) Int. Cl.
*B21C 23/24* (2006.01)
*B21C 23/22* (2006.01)

(52) U.S. Cl. ..... 72/47; 72/342.1

(58) Field of Classification Search ..... 72/47; 148/533; 428/659
See application file for complete search history.

(56) References Cited

U.S. PATENT DOCUMENTS

| | | | | |
|---|---|---|---|---|
| 3,934,441 | A * | 1/1976 | Hamilton et al. | 72/60 |
| 4,252,866 | A | 2/1981 | Matsudo et al. | |
| 4,314,862 | A | 2/1982 | Sudo et al. | |
| 4,510,209 | A | 4/1985 | Hada et al. | |
| 5,525,431 | A | 6/1996 | Nakamaru et al. | |

(Continued)

FOREIGN PATENT DOCUMENTS

| | | |
|---|---|---|
| EP | 0 329 057 A1 | 8/1989 |

(Continued)

*Primary Examiner*—Dana Ross
*Assistant Examiner*—Debra M Sullivan
(74) *Attorney, Agent, or Firm*—Clark & Brody

(57) ABSTRACT

Hot press forming of a steel material is made possible by coating the surface of the steel material with a plated layer of zinc or a zinc alloy and forming thereon a barrier layer which prevents the vaporization of zinc even when heated to 700-1000° C. Corrosion resistance can also be guaranteed without requiring post treatment, and hot press forming of high tensile steel sheet and stainless steel sheet is made possible. The barrier layer is formed by forming an upper plated layer, by surface oxidation, by contact with an oxidizing agent, by contact with Zn and an oxidizing agent, by anodic electrolysis, by cathodic electrolysis, or by coating with a ZnO sol.

17 Claims, 1 Drawing Sheet

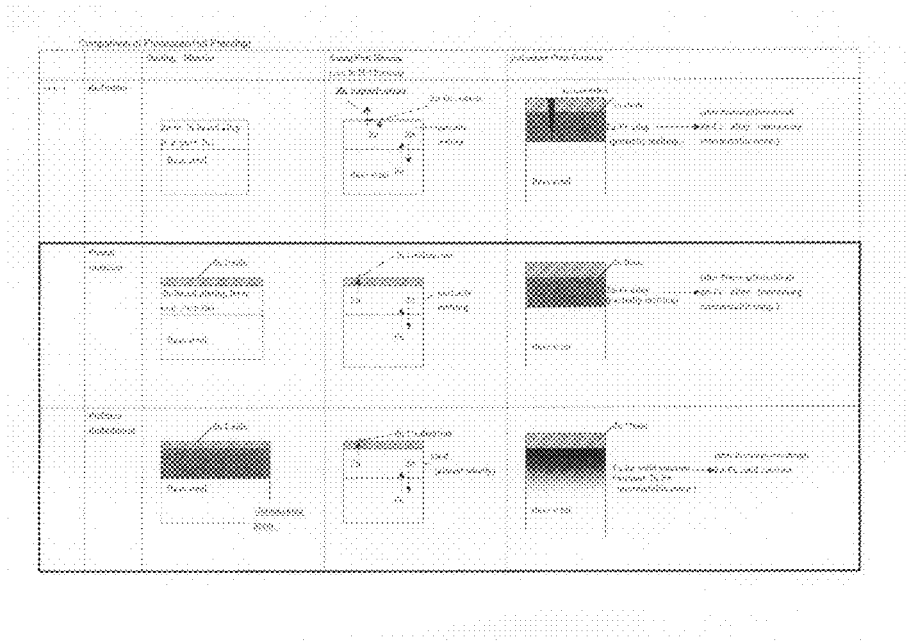

U.S. PATENT DOCUMENTS

| | | | | | |
|---|---|---|---|---|---|
| 5,660,707 | A | * | 8/1997 | Shastry et al. | 205/141 |
| 5,714,049 | A | | 2/1998 | Shastry et al. | |
| 5,866,521 | A | * | 2/1999 | Trivett | 508/411 |
| 6,153,286 | A | * | 11/2000 | Pfaffelhuber et al. | 428/178 |
| 6,230,539 | B1 | * | 5/2001 | Dickson et al. | 72/364 |
| 6,253,588 | B1 | * | 7/2001 | Rashid et al. | 72/57 |
| 6,312,536 | B1 | | 11/2001 | Omiya et al. | |
| 6,564,604 | B2 | * | 5/2003 | Kefferstein et al. | 72/47 |
| 6,655,181 | B2 | * | 12/2003 | Morales | 72/42 |
| 2003/0175548 | A1 | | 9/2003 | Taira et al. | |

FOREIGN PATENT DOCUMENTS

| | | | | |
|---|---|---|---|---|
| EP | 1 288 325 | A1 | | 3/2003 |
| GB | 1490535 | | | 11/1974 |
| JP | 58-58294 | | | 4/1983 |
| JP | 02-190483 | | | 7/1990 |
| JP | 02-263954 | | | 10/1990 |
| JP | 03-017282 | | | 1/1991 |
| JP | 3-61396 | | | 3/1991 |
| JP | 3-107494 | | | 5/1991 |
| JP | 04-072048 | | | 3/1992 |
| JP | 04-325665 | | | 11/1992 |
| JP | 06-179922 | | | 6/1994 |
| JP | 06-240414 | | | 8/1994 |
| JP | 06-287686 | | | 10/1994 |
| JP | 07-116900 | | | 5/1995 |
| JP | 10-140317 | | | 5/1998 |
| JP | 10-204600 | | | 8/1998 |
| JP | 2000-038640 | | | 2/2000 |
| JP | 2000-054161 | | * | 2/2000 |
| JP | 2002-054161 | | | 2/2000 |
| JP | 2000-144238 | | | 5/2000 |
| JP | 2000-160358 | | | 6/2000 |
| JP | 2000-248338 | | | 9/2000 |
| JP | 2000-328220 | | | 11/2000 |
| JP | 2000-328221 | | | 11/2000 |
| JP | 2001-303226 | | | 10/2001 |
| JP | 2001-353548 | | | 12/2001 |
| JP | 2002-12958 | | | 1/2002 |
| JP | 2002-256406 | | | 9/2002 |
| JP | 2002-256448 | | | 9/2002 |
| JP | 2003-73774 | | | 3/2003 |
| JP | 2003073774 | A | * | 3/2003 |

* cited by examiner

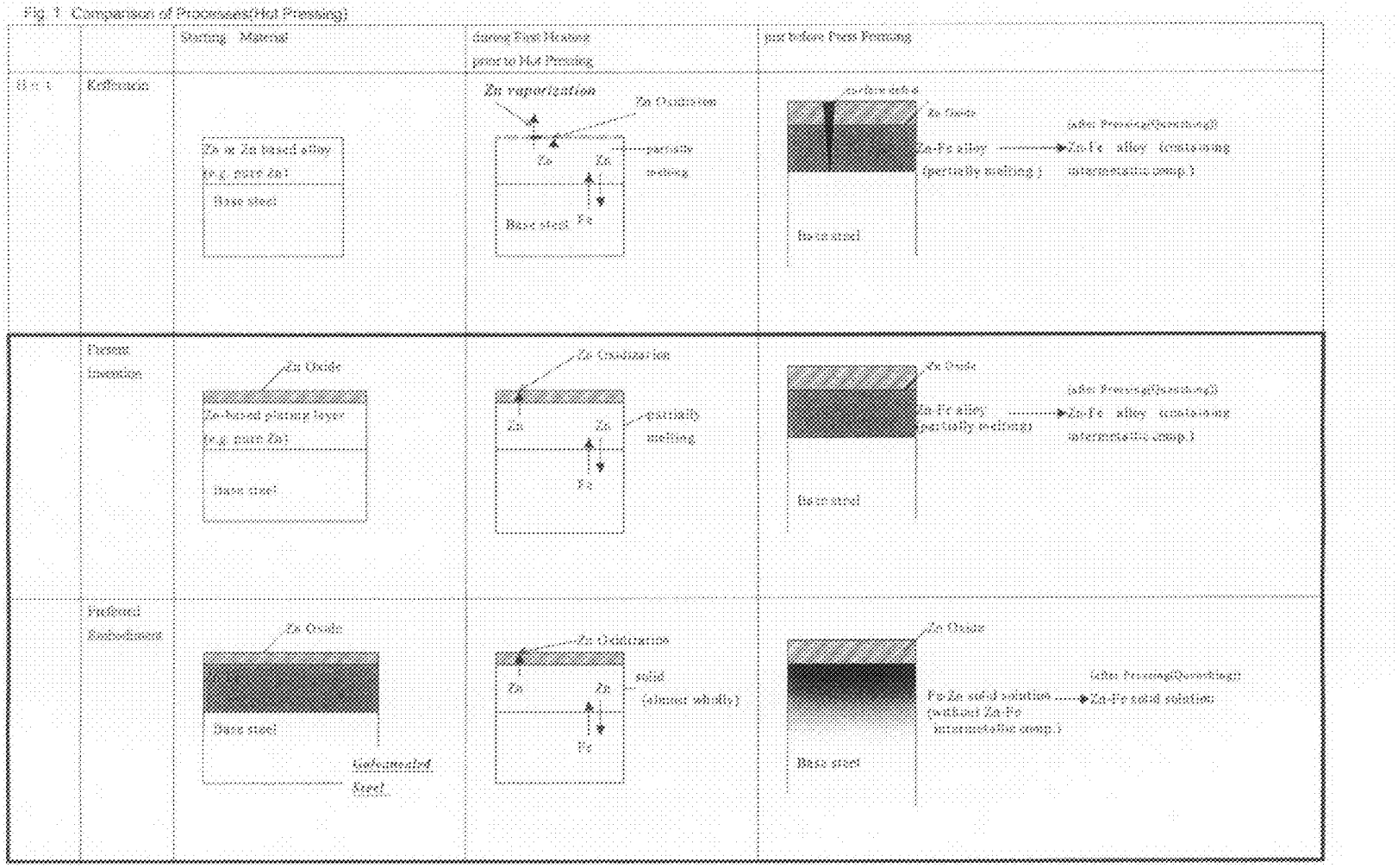
Fig. 1 Comparison of Preconditioning Processes
Use 1
Reference
Steel Material
Zn or Zn based alloy
Base steel
During Post Heating
prior to Hot Pressing
Zn Vapor Condensation
Zn Condensation
Base steel
Just before Press Forming
Zn Coat
Base steel
Patent Invention
Zn Oxide
Zn Metal Plating Layer
Base steel
Zn Coat
Base steel
Preferred Embodiment
Zn Oxide
Base steel
Zn Coat
Base steel

HOT PRESS FORMING METHOD

CROSS-REFERENCE TO RELATED APPLICATIONS

This application is a divisional of U.S. patent application Ser. No. 10/730,978 filed Dec. 10, 2003, now abandoned which is a continuation of International Patent Application No. PCT/JP02/10972, filed Oct. 23, 2002. This PCT application was not in English as published under PCT Article 21(2).

TECHNICAL FIELD

This invention relates to a steel material for hot press forming and particularly a steel material for hot press forming suitable for use in the manufacture of suspensions, bodies, reinforcing parts, and similar parts of automobiles, to a method for its manufacture, and to a hot press forming method for such a steel material.

BACKGROUND ART

In recent years, in order to decrease the weight of automobiles, efforts are being made at reducing the thickness of steel materials which are used in automobiles by increasing their strength. However, this causes some problems as described below, with taking steel sheet, which is representative of steel materials, as an example. When steel sheet is press formed by drawing, for example, as the strength of the steel sheet which is used increases, the contact pressure of the sheet with the die at the time of drawing increases. As a result, galling of the steel sheet or breakage of the steel sheet may occur. If the blank holding force is decreased in order to increase the amount of the material which enters the die at the time of drawing of a steel sheet, with the intention of even slightly lessening this problem, another problem such as variation in the shape after press forming occurs.

Furthermore, so-called springback occurs at the time of press forming. There are countermeasures against this such as the use of a lubricant. However, with high tensile steel sheet having a strength of 780 MPa or above, the effect of such countermeasures is small.

Thus, the press forming of high tensile steel sheet has currently many problems. Hereinafter, this type of material will be referred to as a "difficult-to-press form steel material".

As a technique for press forming such difficult-to-press form steel materials, it is conceivable to subject a steel material to press forming after the material has been heated. Such a technique includes so-called hot press forming and warm press forming. These two methods will hereinafter be collectively referred to simply as "hot press forming".

As disclosed in U.K. Patent 1,490,535, according to hot press forming, it is possible to form a steel sheet into a complicated shape with good dimensional accuracy since the steel sheet is softer and more ductile at a high temperature. Another advantage of hot press forming is that strengthening of the steel sheet due to martensite transformation (so-called hardening) can be simultaneously achieved by heating the steel sheet to the austenite region and then performing quenching at the same time as press forming in the die.

However, since hot press forming is a method in which a heated steel sheet is subjected to working, the surface of the steel sheet to be worked is unavoidably oxidized. Even if the steel sheet is heated in a non-oxidizing atmosphere in a heating furnace, the sheet has a possibility of contacting the atmosphere, for example, when it is removed from the furnace before press forming, resulting in the formation of iron oxides on the surface of the steel sheet. These iron oxides have the problem that they may fall off during press forming and adhere to dies, thereby decreasing productivity, or that an oxide film (scale) made from such iron oxides remains on a product produced by press forming and worsens its appearance. Furthermore, if such an oxide film remains on a press formed product, in the case where the product is subsequently coated with a paint, the resulting painted film has poor adhesion to the steel sheet.

Therefore, after hot press forming, it is necessary to remove a layer of iron oxide, which is a constituent of such an oxide film, by applying shot blasting to the press formed product. This unavoidably results in cost increases. In addition, even if the iron oxide layer is removed, the steel sheet by itself has poor rust preventing properties.

Even if a low alloy steel or stainless steel is used so as to prevent the formation of such an oxide film during heating prior to hot press forming and so as to guarantee corrosion resistance, it is impossible to entirely prevent the formation of an oxide film, and the costs become much higher than for plain steel.

In order to prevent such surface oxidation of steel sheet at the time of hot press forming, theoretically it is effective to use a non-oxidizing atmosphere for both the atmosphere at the time of heating and the atmosphere during the entire pressing process, but this results in a large increase in equipment costs.

Due to these circumstances, even today, hot press forming is not sufficiently utilized.

An outline of current technology which has been proposed in patent applications is as follows.

One advantage of hot press forming is that heat treatment can be performed simultaneously with press forming. It is proposed in JP 07-116900A (1995) to simultaneously perform surface treatment at this time. However, there is no disclosure therein with respect to a means of solving the above-described problems due to surface oxidation.

A steel sheet for hot working is proposed in JP 2000-38640A, which is coated with aluminum in order to provide the steel sheet with resistance to oxidation at the time of hot working. However, this steel sheet, too, is much more expensive than plain steel.

As proposed in JP 06-240414A (1994), from just the standpoints of improving rust preventing properties or corrosion resistance, the addition of elements such as Cr and Mo to the steel composition of a steel material is employed in some cases. However, with such a countermeasure, not only do the costs increase due to the addition of Cr and Mo, but in the case of a material for press forming, there is the problem of a deterioration in press formability due to the addition of these alloying elements.

DISCLOSURE OF THE INVENTION

An object of this invention is to provide a steel material for hot press forming, which can guarantee sufficient corrosion resistance without causing a significant deterioration in appearance during hot press forming.

A specific object of this invention is to provide a technique which makes hot press forming of a steel sheet possible without the need for post treatment for guaranteeing corrosion resistance and which can at the same time guarantee corrosion resistance.

We conceived of the idea that press forming is not performed on a steel sheet at room temperature but after it is heated to a high temperature in order to decrease the resistance of the sheet to deformation and that such hot press forming is applied to a plated steel sheet, which by nature has excellent corrosion resistance, in order to guarantee excellent corrosion resistance without performing post treatment of the steel sheet. Furthermore, based on this, we thought of applying hot press forming to a plated steel sheet having a zinc-based plated coating, which has a sacrificial corrosion protecting effect in a corrosive damp environment. However, hot press forming indicates that steel sheet should be heated to a temperature of 700-1000° C. before press forming, and this temperature is higher than the melting point of the zinc-based plated coating. Thus, for hot press forming of a steel sheet plated with a zinc-based metal, it was predicted that the plated layer would melt and run off from the steel surface or vaporize during heating to such a high temperature whereby the plated layer disappears, or that even if it remained, the surface properties would be markedly deteriorated.

While subsequently performing various studies, we thought that some sort of change might occur by the formation of an alloy between the zinc-based plated layer and the base steel sheet during heating. When hot press forming was actually performed on plated steel sheets having various plating compositions after heating to a temperature of 700-1000° C. in various atmospheres as a preliminary test, contrary to previous predictions, it was found that hot press forming could be carried out by virtue of the formation of an oxide film of zinc on the surface of the plated layer. The oxide film serves as a kind of barrier layer which prevents vaporization of zinc in the underlying plated layer. The surface barrier layer should be formed to a certain extent prior to the heating stage preceding hot press forming, and it is presumed that the formation of the barrier layer still proceeds during the subsequent heating stage to 700-1000° C.

When the zinc-based plated layer was analyzed, it was found that alloying has considerably progressed in the layer, thereby causing the plated layer to have an elevated melting temperature, which contributes to prevention of the vaporization of zinc from the surface of the plated layer and suppression of the formation of iron oxides on the surface of the steel sheet. Moreover, it was also found that a plated layer which has been heated in this manner has good adhesion between the plated layer and the base steel sheet even after hot press forming.

Therefore, it was concluded that hot press forming can be carried out by utilizing a zinc plated steel sheet having a zinc oxide film on its surface.

Thus, if a steel sheet having a plated layer formed by zinc plating or zinc alloy plating (these two plating methods being hereinafter referred to collectively as "zinc-based plating" or simply as "zinc plating" in some cases) is heated so as to form a ZnO layer sufficiently on the surface of the plated layer, it is possible to suppress the vaporization of zinc during the heating stage in the process of hot press forming. Furthermore, while the plated steel sheet is heated so as to form the ZnO layer, mutual diffusion of Fe and Zn occurs between the base steel sheet and the plated layer, and as a result, the mass % of Fe in the plated layer increases to form a Fe—Zn alloy layer. Namely, if a steel sheet having an appropriate plated layer of zinc or a zinc alloy is heated, a three-layer structure comprising, in order from the surface, a ZnO layer, a Fe—Zn alloy layer, and the base steel sheet is obtained, and iron oxides, which are harmful to hot press forming, are not formed.

Thus, in the present invention, the reason why a plated layer remains even when the plated layer is heated to a temperature close to the melting point of the plated layer is thought to be that an oxide film layer having good adhesion and having better heat resistance than the plated layer is formed on the surface of the plated layer and it acts as a barrier layer which obstructs vaporization of zinc. In order to fully exhibit such an effect, the degree of alloying between the plated layer and the steel sheet has an influence, and such alloying should progresses sufficiently to increase the melting point of the plated layer itself. It is presumed that preferably due to the effect of both of these mechanisms, even if the plated steel sheet is heated to 950° C. which is higher than the melting point of zinc which constitutes the plated layer, the plated layer does not disappear and oxidation of the surface of the steel sheet is suppressed.

Of course, such a surface ZnO layer may be previously formed on the surface of the plated layer by various means other than heating. For various reasons, excessive heating may be applied in some cases to a steel sheet when the steel sheet is subjected to hot press forming. For example, while using the same steel material having a high carbon content, heating may be performed in some cases at a higher temperature (such as at 900° C. or above) or for a longer period of time (such as 5 minutes or more) than usual in order to provide the steel material with increased strength, or a heating line may be stopped by accident or its traveling speed may be decreased for convenience of production. Even in such cases, it was found that if a ZnO layer, which is the main constituent of the barrier layer which is formed on the surface in the heating stage of hot press forming, is positively formed in advance on the surface of a zinc plated coating, hot pressed products of good quality can be obtained even under conditions in which heating is applied excessively or at a higher temperature in the process of hot press forming.

As a result of further studies, we found that by previously forming a metal plated layer of Fe, Co, Ni, or an alloy thereof atop the zinc plated layer of a zinc-based plated steel sheet, the upper metal plated layer can function as the above-described barrier layer, and as described above, hot press formed products with stable quality can be produced even if excessive heating is applied in the process of hot press forming.

Namely, when a steel sheet having only a zinc plated layer is heated, oxides form on the surface of the plated layer, and at the same time, an alloying reaction takes place between the steel sheet and the plated layer. At this time, if the oxidation reaction of the surface proceeds too much, even the base steel sheet may also be oxidized. However, when a metal plated layer of Fe, Co, or Ni is applied as an upper layer on the zinc plated layer, the base steel sheet is less susceptible to oxidation, compared to the case in which only a zinc plated layer is formed, since the Fe, Co, or Ni metal quickly reacts with zinc to form a heat-resisting alloy layer. Therefore, good adhesion between the base steel sheet and these plated layers can be guaranteed, and adherence of scales to dies at the time of hot press forming is suppressed, thereby leading to the production of press formed products of good quality. It was also confirmed that such press formed products satisfy coatability required for a subsequent paint-coating step.

In JP 2000-144238A and JP 2000-248338A, a technique is disclosed in which a portion of a metallic part formed by cold working a steel sheet is quenched after high frequency induction heating to perform transformation strengthening of the steel sheet. In these Japanese patent applications, steel sheets having a zinc-based coating are used for the purpose of rust prevention, but in order to suppress dissipation of zinc during heating, the heating is limited in such a manner that the heating temperature is at most 850° C. or the heating time is short. If heating is performed at 850° C. or below, the desired single austenitic phase does not form by heating, so the volume percentage of martensite formed after quenching becomes too small to attain a high strength. If heating is performed for a short period of time, cementite can not be completely dissolved during heating, and the amount of carbon in solid solution becomes so small that an insufficient strength may be obtained after quenching.

If one considers to apply these techniques to hot press forming, it is difficult from the standpoint of equipment to carry out heating and quenching in a short period of time. Furthermore, when working is carried out at a high temperature, it is not clear whether there is damage to the plated coating. Therefore, if these techniques were applied without changes to hot press forming, it is predicted that it would be difficult to obtain a material having high strength and excellent corrosion resistance. Namely, the present invention cannot be conceived from this prior art.

BRIEF DESCRIPTION OF THE DRAWINGS

FIG. 1 is a schematic view of a thermal history which simulates a continuous hot dip galvanizing line used in Example 8.

BEST MODE FOR CARRYING OUT THE INVENTION

Next, specific modes of the present invention will be explained in detail. In this specification, "%" when specifying the composition of steel or plating means "mass %".

Base Steel Material

The base steel of a plated steel material for hot press forming according to the present invention is not critical as long as it has good wettability with molten plating metal when subjected to zinc-based plating by hot dipping and good adhesion of the plated coating thus formed. However, due to the characteristics of hot press forming, a difficult-to-press form steel material, such as a high tensile steel sheet or a hardenable steel sheet (such as a steel sheet having a chemical composition like that shown below in Table 1) which exhibits a high strength and high hardness by quenching after hot forming is particularly preferred from a practical standpoint. Depending upon the use, a soft material is desired in some cases. In such cases, it is possible to use a steel sheet having low hardenability, for example.

According to a more preferred mode of the present invention, the chemical composition of the above-described hardenable steel is as follows.

C: 0.08-0.45%

Carbon (C) is an important element for increasing the hardenability and determining the strength after hot press forming of a steel sheet. If the C content is less than 0.08%, its effect is insufficient. On the other hand, a C content exceeding 0.45% leads to a deterioration in toughness and weldability. The C content is more preferably 0.1-0.3%. When hardenability is not required, the C content need not be in this range, but it is preferably at most 3.0% since a C content exceeding 3.0% may cause a decrease in toughness.

Mn and/or Cr (Total Amount): 0.5-3.0%

Mn and Cr are extremely effective elements for increasing the hardenability of steel sheet and guaranteeing stable strength after hot press forming. However, if the total content of (Mn and/or Cr) is less than 0.5%, the effect thereof is insufficient. On the other hand, if the total content of (Mn and/or Cr) exceeds 3.0%, the effect thereof saturates, and it becomes difficult to guarantee a stable strength. More preferably, the total content of (Mn and/or Cr) is 0.8-2.0%.

In the present invention, in order to guarantee hardenability by hot press forming, it is sufficient to define the contents of C, Mn, and Cr as described above.

More preferably, in order to increase strength, or to more stably realize the properties, other added elements are prescribed in the following manner.

Si: at most 0.5%, P: at most 0.05%, S: at most 0.05%, Ni: at most 2%, Cu: at most 1%, Mo: at most 1%, V: at most 1%, Ti: at most 1%, Nb: at most 1%, Al: at most 1%, N: at most 0.01%

These elements have the effect of increasing the hardenability of steel sheet and of stably guaranteeing strength after hot press forming when at least one of them is added. However, the effect thereof is not little increased when contained in excess of the upper values, and this leads to a needless increase in costs. Therefore, the content of each alloying element is in the above range.

It should be noted, however, that P and S are unavoidably present, and Si and/or Al may be added as deoxidizing agents.

B: 0.0001-0.004%

B is an optional element which increases the hardenability of steel sheet and which is important for further increasing the effect of obtaining the desired strength after hot press forming with certainty. However, the effect of B is insufficient if the content thereof is less than 0.0001%, whereas its effect saturates and costs increase if the B content exceeds 0.004%. More preferably the B content is 0.0005-0.002%.

In the present invention, when zinc-based plating is performed by hot dipping and particularly by galvanealing (hot dip galvanizing followed by annealing to cause alloying of the plated layer), it is desirable for the base steel sheet to have good wettability with plating metal, good adhesion of plated coating formed by plating, and a good galvanealing speed when performing heat treatment for galvanealing. From this standpoint, it is more preferred to control the P and Si content of the base steel sheet in the following manner.

P: P is an element which reduces the galvanealing speed of a zinc plated coating. The galvanealing speed increases with reducing the P content, thereby making it possible to reduce the temperature of an galvanealing furnace or increase the transport speed of sheet through the furnace, contributing to an increase in productivity. A preferred range of the P content is at most 0.015% and more preferably at most 0.010%.

Si: Si is an element which impedes the wettability with plating metal at the time of hot dip zinc-based plating and reduces the galvanealing speed of a zinc plated coating. The Si content is at most 0.5% in order to guarantee wettability with plating metal. If the Si content is decreased, the galvanealing speed increases, thereby making it possible to reduce the temperature of an galvanealing furnace or increase the transport speed of sheet through the furnace, contributing to an increase in productivity. A preferred range of the Si content for this purpose is at most 0.1% and more preferably at most 0.05%.

The steel material on which press forming is performed according to the present invention is generally in the form of a steel sheet. Types of hot press forming which can be applied in accordance with the present invention include bending, drawing, bulging, bore (hole) expanding, flanging, and the like. Depending upon the type of press forming, bar steel, steel wire, steel pipe, and the like can be used as a material for working.

Even a steel which has problems with respect to wettability with plating metal or adhesion of plated coating such as Si-containing steels or stainless steels can be used in the present invention as long as a means capable of increasing the adhesion of plated coating such as pre-plating treatment is applied to the base steel material.

TABLE 1

| Steel Type | Chemical Compositions of Steels (mass %) | | | | | | | | | |
|---|---|---|---|---|---|---|---|---|---|---|
| | C | Si | Mn | P | S | Al | Ti | N | Cr | Mo |
| A | 0.2 | 0.3 | 1.3 | 0.01 | 0.002 | 0.05 | 0.02 | 0.004 | — | — |
| B | 0.4 | 0.2 | 1.2 | 0.01 | 0.001 | 0.03 | 0.01 | 0.003 | — | — |
| C | 0.1 | 0.05 | 1.1 | 0.02 | 0.005 | 0.04 | 0.01 | 0.003 | — | — |

Zinc-Based Plated Layer

According to the present invention, a zinc-based plated layer having a surface barrier layer can be formed on a base steel sheet by performing hot dip galvanizing (zinc plating) as usual, for example, followed by heating in an oxidizing atmosphere, i.e., galvanealing heat treatment under prescribed conditions. Such heat treatment is carried out by reheating the galvanized steel sheet in a gas furnace or the like. At this time, not only oxidation of the surface of the plated layer but metal diffusion between the plated layer and the base steel sheet takes place. The heating temperature therefor is usually 550-650° C.

Such a plated layer is usually formed directly on the surface of the steel sheet, but another plated layer or the like may be present between such a plated layer and the surface of the steel sheet. The plated layer is usually formed on both surfaces of the steel sheet, but as long as the other surface has a pretreatment layer or a protective layer which is not harmful to hot press forming, the above-described plated layer according to the present invention may be formed on just one surface of the steel sheet.

In actual plating operation according to the present invention, in the case of hot dip zinc-based plating, a steel sheet is dipped in a molten zinc or zinc alloy plating bath and pulled up from the bath. The coating weight of plating is controlled by the speed of pulling up and by adjusting the flow rate of wiping gas which is blown from nozzles. Galvanelaing heat treatment is carried out by additional heating in a gas furnace or induction heating furnace or the like after plating treatment. Such a plating operation can be carried out either continuously using a steel strip or batchwise using cut steel sheets.

Of course, if a plated layer of a prescribed thickness can be obtained, a plated layer can be formed by any other plating method, such as electroplating, flame spraying, or vapor deposition plating.

The coating weight of plating is preferably at most 90 g/m$^2$ as converted to the weight of Zn. If it exceeds this value, a zinc oxide layer as a barrier layer is adequately formed during heating, but it may be formed in nonuniform manner, thereby causing problems with respect to its appearance. In addition, the mutual diffusion of Fe and Zn does not progress sufficiently, and a molten zinc layer remain at the end of the heating. As a result, zinc may scatter at the time of hot press forming and contaminate a die. If it is too thin, such as less than 10 g/m$^2$, it becomes impossible to guarantee a desired corrosion resistance after press forming, or it becomes impossible to form a zinc oxide layer necessary to suppress oxidation of the steel sheet during heating. Normally the coating weight of plating is at least approximately 20 g/m$^2$. In the case of more severe heating such as when the heating temperature increases, good performance is obtained when it is preferably in the range of 40-80 g/m$^2$ and more preferably in the range of 45-65 g/m$^2$.

The zinc-based plated layer may have any composition. It may be a pure zinc plated layer, or it may be a zinc alloy plated layer which contains at least one alloying element such as Al, Mn, Ni, Cr, Co, Mg, Sn, and Pb in a suitable amount in accordance with the objective of addition of such element. The plating layer may contain some of Be, B, Si, P, S, Ti, V, W, Mo, Sb, Cd, Nb, Cu, Sr, and the like, which may be unavoidably incorporated from raw materials or other sources.

Examples of zinc alloy plating include the following alloy systems:

zinc-iron alloy plating, zinc-12% nickel alloy plating, zinc-1% cobalt alloy plating, 55% aluminum-zinc alloy plating, zinc-5% aluminum alloy plating, zinc-chromium alloy plating, zinc-aluminum-magnesium alloy plating, tin-8% zinc alloy plating, and zinc-manganese alloy plating.

Preferred is a pure zinc plated layer or a galvanealed layer obtained by heating or annealing a pure zinc plated layer because of its low cost.

A still more preferred plated layer is one formed by galvanealing and containing 5-80% Fe, more preferably 10-30% Fe, and still more preferably 13-20% Fe in the plated coating.

The reason for this is as follows. Before a ZnO layer is formed over the entire surface of the plated layer, formation of a ZnO layer and Zn vaporization compete with each other during heating. Therefore, if the initial mass % of Fe in the plated layer is as low as less than 5%, the plated layer has a low melting point. In this case, during heating, mutual diffusion of Fe and Zn does not sufficiently proceed, and due to its increased vapor pressure, Zn vaporizes before the ZnO layer is formed over the entire surface of the plated layer, so the formation of iron oxides cannot be suppressed. On the other hand, when the initial mass % of Fe in the plated layer is too high, it becomes difficult to form a ZnO layer over the entire surface, and the underlying Fe—Zn alloy layer tends to oxidize, thereby easily causing the formation of iron oxides. In the case of press forming performed at room temperature, as the Fe content of a galvanealed coating increases, the workability of the plated coating decreases. Therefore, the Fe content was at most around 13%. However, in hot press forming according to the present invention, since both the steel sheet and the plated coating are softer than at room temperature, it is possible to perform press forming even if the Fe content is higher.

Normally, a hot dip galvanizing bath contains Al. In the present invention, the Al content of the plated coating is preferably in the range of 0.08-0.4%. More preferably it is 0.08-0.3%. In order to increase the Fe content of the plated coating, it is preferable to have a low Al content.

Barrier Layer

According to the present invention, the zinc-based plated layer has a barrier layer formed on the surface of the plated layer for preventing Zn vaporization during heating. In the case of an oxide film comprising ZnO (zinc oxide) which functions as a barrier layer, its thickness is usually around 0.01-5.0 μm, and its weight is sufficient if it is at least 10 mg/m$^2$ as converted to the weight of Zn.

Instead of the above-described oxide film, an upper plated layer of a metal or an alloy (hereinafter referred to as an "upper plated layer") may be formed as a barrier layer. Normally, the coating weight thereof is on the order of 0.2-10 g/m$^2$.

Upper Plated Layer

An upper plate layer may be formed as a barrier layer atop the zinc-based plated layer by plating with at least one metal or alloy selected from the group consisting of Fe, Co, Ni, and alloys thereof. Compared to the zinc-based plated layer alone, when heating is performed prior to hot press forming, the plated layer is 0.25 less susceptible to the formation of an oxide layer, since the Fe, Co, or Ni metal in the upper plated layer quickly reacts with zinc in the zinc-based plated layer to form a heat-resisting alloy layer, so it is more suitable for hot press forming.

The coating weight of the upper plated layer is preferably at least 0.2 g/m$^2$. If it is lower than this value, no appreciable effect of the upper plated layer compared to zinc plating can be observed. A preferable maximum coating weight of the upper plated layer is 10.0 g/m$^2$. If the coating weight exceeds this value, the effect of the upper metal or alloy plated layer atop the zinc-based plated layer saturates, so it is disadvantageous from the standpoint of economy. Furthermore, metals such as Fe, Co, and Ni or their alloys generate a potential difference with respect to zinc, which often causes corrosion to occur easily, thereby deteriorating the post-painting corrosion resistance of the plated steel sheet.

Such an upper plated layer is normally formed by electroplating, but it may be formed by sputtering, vapor deposition, or other suitable method in some cases.

Zinc Oxide Layer

As described below, there are various methods of forming a zinc oxide (ZnO) layer. Any of the following methods can be applied in accordance with the circumstances of the manufacturing process. A preferred mode of embodiment will be described for each method.

(1) The amount of zinc oxide and measurement thereof

As stated earlier, a ZnO layer acts as a "barrier layer". The effect thereof is appreciable when the amount of Zn contained in the ZnO layer is at least 10 mg/m$^2$. There is no particular upper limit for this amount. However, if the amount is too large, powdering and the like may occur, and the above-described function as a barrier layer saturates, so it is preferably at most 10,000 mg/m$^2$. More preferably, the amount of Zn in the ZnO layer is in the range of at least 100 mg/m$^2$ and at most 2000 mg/m$^2$.

Various methods capable of forming a ZnO layer are conceivable. The amount of ZnO and the method for its manufacture are preferably selected so as to be suitable for the hot press forming process.

The amount (weight) of Zn contained in a zinc oxide layer of a zinc-based plated steel material can be determined either of the following methods: a method in which the plated coating is dissolved in a 5% iodine solution in methanol, and the residue which is separated from the solution is dissolved in hydrochloric acid to determine the amount of Zn in the resulting solution; and a method in which only the surface oxide film of the plated coating is dissolved in an aqueous ammonium bichromate solution to determine the amount of Zn in the resulting solution. The amount of Zn in a solution can be determined by emission spectrometry such as ICP (inductive coupling plasma) emission spectrometry using a blank solution thereof as a control.

(2) Surface oxidation method

This is the treatment that a steel material which has been subjected to plating with zinc or a zinc alloy is oxidized by heating to form a zinc oxide layer on the surface of the plated coating. This method has been described previously.

In the case of hot dip zinc-based plating, after plating is performed on a steel material, the material is cooled normally in an inert atmosphere. In this case, a zinc oxide layer can be formed during cooling by adjusting the cooling atmosphere to a slightly oxidizing atmosphere. The same object can also be achieved by heating a zinc plated layer after a plating process is performed under normal conditions. Particularly in the case of an electroplated material, since heating is not performed during plating, the latter method is effective. A preferable oxidizing atmosphere which is used for this purpose can be obtained by increasing the dew point of the atmosphere. In particular, a ZnO layer can be efficiently formed by heating in an atmosphere with a dew point of 30° C. or above. The heating temperature is preferably at most the melting point of zinc. The object can also be achieved by increasing the dew point of the atmosphere of the galvanealing furnace used to cause alloying of a zinc coating formed by hot dipping. This can be carried out by heating in an oxidizing atmosphere, i.e., by carrying out normal galvanealing heat treatment.

(3) Oxidizing agent contacting method

This is the treatment that a steel material which has been subjected to zinc-based plating is brought into contact with a solution containing an oxidizing agent.

For example, an aqueous solution containing nitric acid ($HNO_3$), a nitrate (such as $NaNO_3$, $KNO_3$, or $Zn(NO_3)_2$), a permanganate (such as $KMnO_4$), a bichromate (such as $K_2Cr_2O_7$), hydrogen peroxide ($H_2O_2$), or the like as an oxidizing agent can be used to contact with a plated steel material, resulting in the formation of a ZnO layer on the surface of the plated material. The concentration of the oxidizing agent in the solution which is used can be determined based on the allowable process conditions (the duration and temperature for contact). It is possible to form a ZnO layer with the weight of at least 10 mg/m$^2$ (as converted to the weight of Zn) when the concentration is roughly in the range of 1-100 g/l.

Depending upon the circumstances of the process, the duration of contact is preferably at least 0.5 seconds and more preferably 2-10 seconds. A longer duration of contact does not impair the effects of the present invention, but large equipment may be required or productivity may be impeded. Therefore, it is important to efficiently form a ZnO layer in a shorter length of time. In particular, when the present invention is applied to a zinc-based plated layer formed by hot dipping, it is preferable that the surface be contacted by an aqueous alkaline solution (such as an aqueous 10% NaOH solution) prior to this treatment to remove any impurities such as Al on the surface. As a result, ZnO can be efficiently formed at the subsequent treatment by contacting with an aqueous solution containing an oxidizing agent.

The contact of the plated steel material with the aqueous solution may be performed using any of immersion, spraying, roll coating, knife coating, and the like, and it is preferably followed by rinsing with water and drying. Without rinsing with water, while ZnO is formed, the salt used as an oxidizing agent remains deposited on the surface, thereby deteriorating the resistance to rusting of the steel material.

(4) Zn/oxidizing agent contacting method

This is the treatment that a steel material which has been subjected to zinc-based plating is brought into contact with an aqueous solution containing Zn ions and an oxidizing agent.

The aqueous solution to be contacted contains, in addition to an oxidizing agent, a compound which liberates Zn ions. The oxidizing agent in this case may be the same as that in the above-described oxidizing agent contacting method. By adding Zn ions to an aqueous solution containing an oxidizing agent, a ZnO layer can be formed even more efficiently. In the absence of Zn ions, dissolution of the plated layer takes place before the formation of ZnO. The pH at which dissolution of the plated layer takes place is generally low, while the pH at which ZnO is formed and precipitated is relatively high. By including both Zn ions and an oxidizing agent in a relatively high pH region (pH 3-7), it becomes possible to efficiently form ZnO on the surface of the plated layer.

An aqueous solution of a zinc source such as zinc sulfate ($ZnSO_4.7H_2O$), zinc nitrate ($(Zn(NO_3)_2.6H_2O$), or the like can be prepared, and it can be used with the above-described oxidizing agent to form ZnO on the surface of a plated steel sheet. Other conditions can be the same as for the above-described oxidizing agent contacting method.

(5) Anodic electrolysis method

This is the treatment that a steel material which has been subjected to zinc-based plating is treated by anodic electrolysis.

A ZnO layer can be formed on the surface of a plated steel material by performing electrolytic oxidation in an aqueous solution using the plated steel material as an anode. In this case, the aqueous solution is preferably either an acidic or alkaline solution. When it is alkaline, it is preferable to use an aqueous NaOH or KOH solution with 1-10 mass % concentration. If the concentration is too low, the current efficiency of the solution decreases. If it is too high, the zinc in the plated layer is etched excessively, thereby adversely affecting the surface quality. When the aqueous solution is acidic, an aqueous hydrochloric acid or sulfuric acid solution may be used with a concentration of 0.1-1 mass %. Likewise, if the concentration is too low, the solution has a decreased current efficiency, and if it is too high, the zinc in the plated layer is etched excessively, thereby adversely affecting the surface quality. The current density is preferably in the range of 1-100 $A/dm^2$ and can be varied depending on the process and the treatment speed. However, if the current density is too large, the current efficiency worsens, and the surface quality decreases. If the current density is too small, the treatment time becomes long. For these reasons, the current density is more preferably in the range of 5-30 $A/dm^2$.

(6) Cathodic electrolysis method

This is the treatment that a steel material which has been subjected to zinc-based plating is treated by electrolysis using the steel material as a cathode in an aqueous solution containing Zn ions and an oxidizing agent.

A ZnO layer can be formed on the surface of the plated steel material by this method. The contents of a source of Zn ions and an oxidizing agent in the aqueous solution may be the same as for the Zn/oxidizing agent contacting method. When the aqueous solution is required to have electrical conductivity, one or more salts may be added so as to guarantee the required conductivity. The current density is preferably in the range of 1-100 $A/dm^2$, but it can be suitably selected based on the process and the treatment speed. However, if the current density is too large, the current efficiency worsens, and the surface quality decreases. If the current density is too small, the treatment time becomes long. For these reasons, the current density is more preferably in the range of 5-30 $A/dm^2$.

(7) ZnO sol application method

This is the treatment that a steel material which has been subjected to zinc-based plating is treated by applying a ZnO sol-containing solution to the plated surface.

A ZnO sol can be formed by gradually neutralizing an aqueous acidic solution containing zinc ions after an organic additive capable of stabilizing a colloid (such as organic acid ions) has been added to the aqueous solution. It is also possible to form a ZnO sol by finely dividing ZnO into microparticles and combining them with an organic binder (such as polyacrylic acid or polyvinyl alcohol). A ZnO layer can be formed by applying such a ZnO sol-containing solution on a zinc-plated steel material followed by drying the applied film.

The greater the amount of the organic additive or binder which is added, the greater is the binding effect of the resulting ZnO layer to the plated steel sheet, which is desirable. However, such an organic component is gasified at the time of hot press forming, thereby causing problems. Therefore, the amount of the organic additive or binder which is added is preferably at most 5 parts by weight and more preferably at most 1 part by weight with respect to 100 parts by weight of ZnO.

The ZnO sol-containing solution may be applied by any suitable method such as immersion, spraying, roll coating, knife coating, and the like. The subsequent drying is preferably carried out at 80° C. or higher. If moisture remains after drying, the plated layer may have a deteriorated resistance to rusting or a tacky surface which makes handling of the steel material poor.

Next, a manufacturing method for a steel sheet for hot press forming according to the present invention will be described.

A steel sheet according to the present invention is preferably heated to a temperature in the austenitic range or near the austenitic range prior to hot press forming and then subjected to press forming in this temperature range. Accordingly, the mechanical properties of the steel sheet at room temperature prior to heating are not critical, and there are no particular restrictions on the metallographic structure of the steel sheet prior to heating. Thus, either a hot rolled steel sheet or a cold rolled steel sheet may be used as the base steel sheet which is subjected to plating, and as long as it is a steel sheet, there are no restrictions on the method of its manufacture. However, from the standpoint of productivity, a preferred manufacturing method of a base steel sheet is as described below.

Hot Rolling

Hot rolling can be carried out in a conventional manner. From the standpoint of the stability of rolling, it is preferably carried out at a temperature in the austenitic range. If the coiling temperature is too low, the hot-rolled steel has the martensitic structure with an increased strength, which makes transport of the steel sheet in a continuous hot dip galvanizing line and cold rolling difficult. On the other hand, if the coiling temperature is too high, an oxide scale having an increased thickness is formed, and it causes the efficiency of the subsequent pickling to decrease, or when plating is immediately performed without pickling, it causes the adhesion of the plated coating to worsen. Accordingly, the coiling temperature is preferably in the range of 500-600° C.

Cold Rolling

Cold rolling is performed in a conventional manner. In the present invention, when the steel sheet has a high carbon content, if cold rolling is performed with an excessively high reduction, the load on the mill becomes high. In addition, if the strength after cold rolling becomes too high due to work hardening, there are problems in a zinc plating line with respect to the weld strength when connecting coils and the sheet transport capacity of the line. Therefore, the reduction of cold rolling is preferably at most 80% and more preferably at most 70%.

If cold rolling is performed, costs correspondingly increase. Therefore, for a steel sheet having a thickness and width which can be manufactured by hot rolling, it is preferable to omit cold rolling and use a hot rolled steel sheet as is.

Zinc-Based Plating

The zinc-based plated layer of a plated steel sheet according to the present invention may be formed by any plating method including hot dipping, electroplating, flame spraying, vapor deposition, and the like. The plating operation may be performed either continuously on a steel strip or successively on cut steel sheets. In general, it is preferable to use a continuous hot dip galvanizing line, which has excellent productivity.

Accordingly, a continuous hot dip galvanizing method will be described below. The plating operation itself has already been described, but it will be supplemented as follows.

A typical continuous hot dip galvanizing line comprises a heating furnace, a cooling zone, a molten zinc bath, and a galvanealing furnace disposed in series. In the present invention, since the metallographic structure of the base steel sheet is not particularly restricted, the heat patterns in the heating furnace and the cooling zone are not particularly restricted. However, when the steel sheet has a high carbon content or includes elements which make the steel hardenable, there is the possibility that the steel sheet have an extremely increased strength while passing through the line. Taking into consideration the ease of transporting a steel sheet in the line and the allowable manufacturing range (the sheet thickness and width), the heat patterns are preferably selected such that the strength of the steel sheet does not excessively increase.

Maximum Heating Temperature

During the heating which is performed prior to hot dipping, when the heating temperature in the heating furnace is less than the $Ac_1$ point of the steel, recovery and recrystallization of the steel sheet take place during heating, and its strength decreases compared to before heating. Accordingly, there are no problems with respect to ease of sheet transport. From the standpoint of conserving heating energy of the furnace, it is preferable to perform heating at a low temperature in a range which will not impede coatability of plating.

On the other hand, if the maximum heating temperature is the $Ac_1$ point or higher, recovery and recrystallization of the steel sheet occur during heating, and an austenitic phase develops. Thus, depending on the subsequent cooling conditions, a transformed phase of high strength may be formed.

Cooling Speed

Since a hot dip galvanizing bath is normally maintained at around 460° C., the steel sheet which has been heated is cooled to the bath temperature. If the heating temperature is less than the $Ac_1$ point, the cooling speed does not affect the metallographic structure of the steel sheet, so cooling may be performed at any speed.

In the case where the heating temperature is the $Ac_1$ point or higher leading to the formation of an austenitic phase, it is not preferable to increase the cooling speed too much, since it causes the austenite to transform into a structure based on bainite or martensite, which has an increased strength. Specifically, the average cooling speed from the maximum heating temperature to 500° C. is preferably at most the critical cooling speed.

A method for determining the critical cooling speed will be described in more detail below in the Examples. The critical cooling speed, which is used as an index of the hardenability of a steel sheet, is the minimum cooling speed which produces a structure which consists solely of a martensitic phase.

Having a small amount of bainite or martensite included in a steel sheet which has been cooled under the above-described conditions does not deny the effect of a manufacturing method according to the present invention. However, from the standpoint of having as low a strength as possible so as to increase the transportability of steel sheet, the cooling speed is preferably made as low as possible in order to avoid the formation of bainite or martensite.

As already stated, according to the present invention, a barrier layer is formed by galvanelaing heat treatment which is performed subsequent to hot dip galvanizing or by other treatment for forming a ZnO layer, or it may be formed by another plating to form an upper plated layer.

Temper Rolling

Temper rolling may be carried out, if necessary, in order to flatten and straighten the steel sheet or to adjust the surface roughness thereof.

A steel sheet which is manufactured in this manner, namely, a zinc-based plated steel sheet having a barrier layer on the surface of the plated layer, is then subjected to hot press forming after heating to a prescribed temperature.

There is no particular restriction on the method of hot press forming of a steel sheet according to the present invention, and press forming can be carried out as usual, but in a hot state. If a steel sheet which has been heated to at least the $Ac_3$ point is press formed under such conditions that cooling occurs at the critical cooling speed or higher, the maximum strength which depends on the composition of the base steel can be obtained.

Prior to hot press forming, the steel sheet is heated normally to 700-1000° C., for example. However, some types of base steel sheet have fairly good press formability, and with such materials, heating can be performed to a somewhat lower temperature. In the present invention, depending upon the steel type, it is also possible that the heating temperature is in the range of so-called warm pressing, but normally, it is in the range of 700-1000° C. as described above.

In the case of a hardenable steel, in the heating step prior to press forming, the steel sheet is heated to a temperature at which a target hardness is attained by quench hardening and kept at that temperature for a certain period. Thereafter, the heated steel sheet is press formed while hot in a die and quenched in the die simultaneously with press forming. When hardening is not required, heating can be performed at a temperature at which the material softens to the extent that press forming can be carried out.

This heating may be performed by a heating method such as heating in an electric furnace or gas furnace, flame heating, resistance heating, high frequency heating, inductive heating, and the like. There are no particular restrictions on the atmosphere for heating. In the case of a steel material on which a barrier layer is previously formed, any atmosphere may be employed as long as it does not adversely affect the retention of the barrier layer.

An advantage of hot press forming is that hardening is achieved simultaneously with press forming. Therefore, it is preferable to use a steel for which such hardening is possible. It is of course possible to heat a pressing die in advance of press forming so as to vary the hardening temperature and control the properties of the pressed product.

According to the present invention, since an oxide layer is not formed during hot press forming, a post-press forming step such as the above-described shot blasting is not always necessary. However, if necessary, the zinc oxide layer on the surface may be removed by shot blasting or the like.

Next, the operation and effects of the present invention will be more specifically described by examples.

EXAMPLES

Example 1

In this example, a hot dipped galvanized (zinc plated) steel sheet of Steel A shown in Table 1 having a sheet thickness of 1.0 mm was subjected to galvanealing heat treatment at 650° C. It was then heated in an atmospheric furnace (furnace under atmospheric conditions) at 950° C. for 5 minutes, after which it was removed from the heating furnace, and in this high temperature state, the steel sheet was subjected to hot press forming by cupping. The hot press forming conditions were a drawing depth of 25 mm, a shoulder radius R of 5 mm, a blank diameter of 90 mm, a punch diameter of 50 mm, and a die diameter of 53 mm. To evaluate press formability, the state of adhesion of the plated layer after press forming was determined by visual observation to determine whether there was peeling of the plated layer. In this example, the temperature of the steel sheet reached 900° C. in nearly 2 minutes.

The painted film adhesion and the post-painting corrosion resistance (referred to simply as the corrosion resistance) of the resulting hot press formed product were evaluated in the following manner.

Painted Film Adhesion Test

A test piece cut from the cupped body obtained in this example was subjected to zinc phosphate treatment under normal conditions therefor using PBL-3080 manufactured by Nihon Parkerizing and then painted by electrodeposition coating with GT-10 coating composition manufactured by Kansai Paint by slope conduction at 200 V. It was then baked at a baking temperature of 150° C. for 20 minutes to form a painted film having a thickness of 20 μm.

The painted test piece was immersed in ion exchange water at 50° C. for 240 hours, after which scratches were made on the painted film in a grid pattern with a spacing of 1 mm using a knife cutter. A peeling test was then performed using polyester adhesive tape manufactured by Nichiban, and the number of remaining squares of the painted film were counted to evaluate the painted film adhesion. The total number of squares made by scratching was 100. The painted film adhesion was evaluated by the number of remaining squares as follows: 90-100 was good (indicated by the symbol ○), and 0-89 was poor (indicated by the symbol X).

Post-Painting Corrosion Resistance Test

A painted test piece was prepared in the same manner as for the painted film adhesion test. Using a knife cutter, a scratch was made on the painted test piece to a depth reaching the base steel, and the test piece was then subjected to a salt spray test as prescribed by JIS Z2371 for 480 hours. Thereafter, the width of blistering of the painted film and that of rusting from the scratch was measured to evaluate the post-painting corrosion resistance.

The post-painting corrosion resistance was evaluated by the larger of either the width of rusting or the width of blistering of the painted film. From 0 mm to less than 4 mm was good (indicated by the symbol ○), and 4 mm or larger was poor (indicated by the symbol X).

The results of the tests are shown in Table 2.

As comparative examples, a Cr—Mo steel sheet, a cold rolled steel sheet, and a stainless steel sheet were heated at 950° C. for 5 minutes, and then the same hot press forming was performed thereon for evaluation of properties as described above.

The results are also shown in Table 2. The properties were good when a galvanealed steel sheet was tested. In contrast, when using a Cr—Mo steel sheet or a stainless steel sheet or a cold rolled steel sheet, the appearance was blackened after heating for hot press forming due to the formation of oxides. In addition, the oxides peeled off, thereby causing the formation of indentation flaws at the time of press forming. Furthermore, the painted film adhesion and corrosion resistance were both poor.

TABLE 2

| Run No. | Material for press forming | Plated coating weight per side (g/m$^2$) | Appearance after heating | Formability | Adhesion of painted film | Corrosion resistance |
|---|---|---|---|---|---|---|
| 1 | Galvanealed steel sheet | 60 | Uniform oxide film formed | No problems | ○ | ○ |
| 2 | Cr-Mo Steel sheet (SCM430) | 0 | Blackened | Peeling of oxide film | X | X |
| 3 | Cold rolled steel sheet (SPC) | 0 | Blackened | Peeling of oxide film | X | X |
| 4 | Stainless steel sheet (SUS410) | 0 | Blackened | Peeling of oxide film | X | X |

Example 2

In this example, tests were repeated for the above-described Steel A generally in the same manner as described in Example 1, but as shown in Table 3, the coating weight of plating was varied, and/or the conditions of galvanealing heat treatment, which was performed immediately after plating, were varied so as to vary the Fe content in the plated coating.

Furthermore, in this example, the galvanealed steel sheet was heated, prior to hot press forming, by either (A) in an atmospheric furnace at 950° C. for 5 minutes, or (B) in an atmospheric furnace at 850° C. for 3 minutes. In Runs Nos. 9-23, the Fe content in the plated layer was varied by varying the temperature (500-800° C.) and the duration (at most 30 minutes) of galvanealing heat treatment before the steel sheet is heated prior to hot press forming. For Runs Nos. 18-23, the heating time prior to hot press forming for condition (B) was prolonged from 3 minutes to 6 minutes, and hot press forming was performed under more severe condition (C).

The results are shown in Table 3.

TABLE 3

| Run No. | Plated coating weight per side (g/m$^2$) | Fe content of plated coating (mass %) | Heating conditions | Appearance after heating | Formability | Adhesion of painted film | Corrosion resistance |
|---|---|---|---|---|---|---|---|
| 1 | 20 | 10 | B | Uniform | No | ○ | ○ |
| 2 | 40 | 10 | B | oxide film | problems | ○ | ○ |
| 3 | 60 | 10 | B | formed | | ○ | ○ |

TABLE 3-continued

| Run No. | Plated coating weight per side (g/m$^2$) | Fe content of plated coating (mass %) | Heating conditions | Appearance after heating | Formability | Adhesion of painted film | Corrosion resistance |
|---|---|---|---|---|---|---|---|
| 4 | 80 | 10 | B | | | ○ | ○ |
| 5 | 90 | 10 | B | | | ○ | ○ |
| 6 | 40 | 10 | A | | | ○ | ○ |
| 7 | 60 | 10 | A | | | ○ | ○ |
| 8 | 80 | 10 | A | | | ○ | ○ |
| 9 | 60 | 5 | B | | | ○ | ○ |
| 10 | 60 | 10 | B | | | ○ | ○ |
| 11 | 60 | 13 | B | | | ○ | ○ |
| 12 | 60 | 15 | B | | | ○ | ○ |
| 13 | 60 | 20 | B | | | ○ | ○ |
| 14 | 60 | 25 | B | | | ○ | ○ |
| 15 | 60 | 30 | B | | | ○ | ○ |
| 16 | 60 | 50 | B | | | ○ | ○ |
| 17 | 60 | 80 | B | | | ○ | ○ |
| 18 | 60 | 10 | C | | | ○ | ○ |
| 19 | 60 | 13 | C | | | ○ | ○ |
| 20 | 60 | 15 | C | | | ○ | ○ |
| 21 | 60 | 20 | C | | | ○ | ○ |
| 22 | 60 | 25 | C | | | ○ | ○ |
| 23 | 60 | 30 | C | | | ○ | ○ |

Heating Condition
A: Press forming after heating in atomospheric furnace at 950° C. × 5 minutes
B: Press forming after heating in atomospheric furnace at 850° C. × 3 minutes
C: Press forming after heating in atomospheric furnace at 850° C. × 6 minutes

Example 3

In this example, each of the steels shown in Table 1 was tested in the same manner as described in Example 1 to evaluate formability, painted film adhesion, and corrosion resistance. The results are shown in Table 4.

TABLE 4

| Run No. | Plated coating weight per side (g/m$^2$) | Fe content of plated layer (mass %) | Type of base Steel (1.2 mm thick) | Appearance after heating | Formability | Adhesion of painted film | Corrosion resistance |
|---|---|---|---|---|---|---|---|
| 1 | 60 | 15 | A | Uniform | No | ○ | ○ |
| 2 | 60 | 15 | B | oxide film | problems | ○ | ○ |
| 3 | 60 | 15 | C | formed | | ○ | ○ |

Example 4

As shown in Table 5, various types of zinc plating or zinc alloy plating were applied to Steel A of Table 1 having a sheet thickness of 1.0 mm, and some of the resulting plated steel sheets were treated by one of the following methods to form a ZnO layer on the surface of the zinc or zinc-alloy plated coating. The coating weight of the ZnO layer thus formed is indicated as the weight of Zn. Each method of forming a ZnO layer was performed under the following conditions.

A: Oxidation of the plated coating by heat treatment in a galvanealing furnace having a dew point of 30° C. or above (with the sheet temperature in the furnace being 460° C. and the residence time in the furnace being arbitrary).

B: Immersion in an aqueous solution of an oxidizing agent (1% nitric acid at 40° C.).

C: Immersion in an aqueous solution of Zn ions+an oxidizing agent (100 g/l of zinc nitrate hexahydrate+10 g/l of nitric acid at 40° C.).

D: Anodic electrolysis in an aqueous 5% NaOH solution with a current density of 20 A/dm$^2$ and an arbitrary conducting time.

E: Cathodic electrolysis in an aqueous solution of Zn ions+an oxidizing agent (50 g/l of zinc sulfate heptahydrate+50 g/l of sodium nitrate at 50° C.) with a current density of 15 A/dm$^2$ and an arbitrary conducting time.

F: Roll coating with a ZnO sol (to which 0.5% polyacrylic acid was added) followed by drying (100° C. for 30 seconds).

Subsequently, after each plated steel was heated under the conditions shown in Table 5 in an atmospheric furnace, it was subjected to a cupping test. The hot press forming in the cupping test was performed on a circular blank with a diameter of 90 mm under the conditions for simulation: a punch diameter of 50 mm, a punch shoulder radius R of 5 mm, a die diameter of 53 mm, a die shoulder radius R of 5 mm, and a drawing depth of 25 mm. The blank holding force (BHF) was 1 ton-F.

The surface condition after press forming was evaluated by visual observation. In addition, painted film adhesion and post-painting corrosion resistance were evaluated in the same manner as in Example 1 for the resulting hot press formed products.

The test results are shown in Table 5.

TABLE 5

| Run No. | Zinc-based plating *1 Plating | Zinc-based plating Coating weight (g/m²) | Conditions for forming ZnO Method | Conditions for forming ZnO Detailed condition | Coating weight of ZnO (mg/m² as Zn) | Heating conditions Temp (° C.) | Heating conditions Time (Min) | Appearance of press-formed product | Coatability with paint Adhesion of painted film | Coatability with paint Corrosion resistance |
|---|---|---|---|---|---|---|---|---|---|---|
| 1 | — | 40 | — | — | — | 900 | 5 | Scale formation and peeling | X | X |
| 2 | EG | 40 | — | — | 1.2 | 900 | 8 | Browned with powdering | X | ○ |
| 3 | GI | 60 | — | — | 6.5 | 900 | 8 | Browned with powdering | X | ○ |
| 4 | EG | 40 | B | Immersion time: 1 sec | 10.8 | 900 | 8 | Browned without powdering | ○ | ○ |
| 5 | EG | 40 | C | Immersion time: 1 sec | 30.5 | 900 | 8 | Normal | ○ | ○ |
| 6 | EG | 40 | B | Immersion time: 3 sec | 65 | 900 | 8 | Normal | ○ | ○ |
| 7 | EG | 40 | C | Immersion time: 4 sec | 120 | 900 | 8 | Normal | ○ | ○ |
| 8 | EG | 40 | D | Conducting time: 3.5 sec | 350 | 900 | 8 | Normal | ○ | ○ |
| 9 | EG | 40 | E | Conducting time: 5 sec | 450 | 900 | 10 | Normal | ○ | ○ |
| 10 | EG | 40 | D | Conducting time: 7 sec | 1200 | 900 | 10 | Normal | ○ | ○ |
| 11 | EG | 40 | E | Conducting time: 10 sec | 1600 | 900 | 10 | Normal | ○ | ○ |
| 12 | EG | 40 | F | — | 3400 | 900 | 10 | Normal | ○ | ○ |
| 13 | EG | 40 | F | — | 6500 | 950 | 8 | Normal but powdering | ○ | ○ |
| 14 | GA | 60 | A | Residence time: 1 sec | 25 | 900 | 8 | Normal | ○ | ○ |
| 15 | GA | 60 | A | Residence time: 2 sec | 124 | 900 | 8 | Normal | ○ | ○ |
| 16 | GA | 60 | A | Residence time: 3 sec | 340 | 900 | 8 | Normal | ○ | ○ |
| 17 | GA | 60 | A | Residence time: 5 sec | 800 | 950 | 10 | Normal | ○ | ○ |
| 18 | GI | 60 | D | Conducting time: 7 sec | 800 | 900 | 8 | Normal | ○ | ○ |
| 19 | GI | 60 | D | Conducting time: 10 Sec | 1300 | 950 | 10 | Normal | ○ | ○ |
| 20 | GI | 60 | B | Immersion time: 5 sec | 120 | 900 | 8 | Normal | ○ | ○ |
| 21 | GI | 60 | C | Immersion time: 10 sec | 300 | 900 | 10 | Normal | ○ | ○ |
| 22 | ZnNi | 30 | — | — | 2 | 900 | 8 | Browned with powdering | X | ○ |
| 23 | ZnNi | 30 | B | Immersion time: 5 sec | 135 | 900 | 8 | Normal | ○ | ○ |
| 24 | ZnNi | 30 | C | Immersion time: 5 sec | 215 | 900 | 8 | Normal | ○ | ○ |
| 25 | ZnNi | 30 | D | Conducting time: 2 sec | 200 | 900 | 8 | Normal | ○ | ○ |
| 26 | ZnNi | 30 | E | Conducting time: 2 sec | 180 | 900 | 8 | Normal | ○ | ○ |

*1: Plating - EG: Zinc electroplating, GA: Galvanealing (Fe: 8 wt %), GI: Hot dip galvanizing, ZnNi: Zinc-nickel alloy electroplating (Ni: 12 wt %)

Example 5

As shown in Table 6, various types of zinc plating or zinc alloy plating were applied to Steel A of Table 1 having a sheet thickness of 1.0 mm, and some of the resulting plated steel sheets were subjected to electroplating in a sulfate bath so as to form an Fe, Co, or Ni plated layer as an upper plated layer. Subsequently, after each plated steel was heated under the conditions shown in Table 6 in an atmospheric furnace, it was subjected to a cupping test. The hot press forming in the cupping test was performed on a circular blank with a diameter of 90 mm under the conditions for simulation: a punch diameter of 50 mm, a punch shoulder radius R of 5 mm, a die diameter of 53 mm, a die shoulder radius R of 5 mm, and a drawing depth of 25 mm. The blank holding force (BHF) was 1 ton-F.

The surface condition after press forming was evaluated by visual observation.

In addition, painted film adhesion and post-painting corrosion resistance were evaluated in the same manner as in Example 1 for the resulting hot press formed products. In this example, however, the evaluation of painted film adhesion was as follows: 100 remaining squares was extremely good (indicated by the symbol ★), 95-99 was good (indicated by the symbol ◎), 90-94 was fairly good (indicated by the symbol ○), and 0-89 was poor (indicated by the symbol X).

As a comparative example, the same hot press forming was performed on a cold rolled steel sheet after the steel sheet was heated at 950° C. for 5 minutes, and an evaluation of properties was performed in the same manner as described above.

The results are shown in Table 6.

TABLE 6

| Run No. | Zinc-based plated layer Plating Type[1] | Zinc-based plated layer Coating Weight (g/m²) | Upper plated layer Plating Type | Upper plated layer Coating Weight (g/m²) | Heating conditions Temp (° C.) | Heating conditions Time (min) | Appearance of press formed product | Adhesion of painted film | Corrosion resistance |
|---|---|---|---|---|---|---|---|---|---|
| 1 | — | — | — | — | 900 | 5 | Scale formation and peeling | X | X |

TABLE 6-continued

| Run No. | Zinc-based plated layer: Plating Type[1] | Zinc-based plated layer: Coating Weight (g/m²) | Upper plated layer: Plating Type | Upper plated layer: Coating Weight (g/m²) | Heating conditions: Temp (° C.) | Heating conditions: Time (min) | Appearance of press formed product | Adhesion of painted film | Corrosion resistance |
|---|---|---|---|---|---|---|---|---|---|
| 2 | GA | 50 | Fe | 0.1 | 900 | 8 | Scale formation and peeling | ◎ | ○ |
| 3 | GA | 50 | Fe | 0.2 | 900 | 8 | Normal | ◎ | ○ |
| 4 | GA | 50 | Fe | 1 | 900 | 8 | Normal | ◎ | ○ |
| 5 | GA | 50 | Fe | 2.2 | 950 | 10 | Normal | ★ | ○ |
| 6 | GA | 50 | Fe | 5.6 | 950 | 10 | Normal | ◎ | ○ |
| 7 | GA | 50 | Fe | 9.5 | 950 | 10 | Normal | ◎ | ○ |
| 8 | GA | 50 | Fe | 12.2 | 950 | 10 | Normal | ◎ | ○ |
| 9 | GI | 50 | Ni | 1 | 900 | 8 | Normal | ◎ | ○ |
| 10 | GI | 50 | Ni | 5.2 | 950 | 10 | Normal | ◎ | ○ |
| 11 | GI | 50 | Ni | 11.5 | 950 | 10 | Normal | ◎ | ○ |
| 12 | GF | 60 | Co | 0.8 | 900 | 8 | Normal | ◎ | ○ |
| 13 | GF | 60 | Co | 2.6 | 950 | 10 | Normal | ◎ | ○ |
| 14 | ZnNi | 30 | Fe | 2.3 | 900 | 8 | Normal | ◎ | ○ |
| 15 | ZnNi | 30 | Fe | 4 | 950 | 10 | Normal | ◎ | ○ |
| 16 | — | — | Ni | 3.1 | 900 | 5 | Scale formation and peeling | X | X |
| 17 | — | — | Co | 1.3 | 900 | 5 | Scale formation and peeling | X | X |

[1]Note:
EG: Zinc electroplating, GA: Galvanealing (Fe: 8%) GI: Hot dip galvanizing, GF: Hot dip galvanizing containing 5% Al ZnNi: Zinc-nickel alloy electroplating (Ni: 12%)

Example 6

Steels having the compositions shown in Table 7 were prepared in a laboratory and cast into slabs. After the slabs were heated at 1200° C. for 30 minutes, they were hot rolled at 900° C. or above to form steel sheets with a thickness of 3.2 mm. After hot rolling, in order to simulate the process of coiling, each steel sheet was cooled to 550° C. by water spraying, then placed in a furnace and held therein at 550° C. for 30 minutes, and finally cooled to room temperature at a speed of 20° C./hour. After the resulting hot rolled sheet was descaled by pickling, it was cold rolled to reduce its thickness to 1.0 mm. Using a simulator for galvanizing, hot dip zinc galvanizing was performed on a piece cut from the resulting cold rolled steel sheet, and then galvanealing heat treatment was performed thereon. The Fe content of the resulting plated layer was varied by varying the temperature (500-800° C.) and duration (at most 30 minutes) of galvanealing heat treatment.

The galvanealed steel sheet was cut into rectangular pieces with a width of 50 mm, which were heated in an atmospheric furnace at 850° C. for 3 minutes and then, while hot, subjected to hot press forming into a cup shape. The die which was used had a punch width of 50 mm, a punch shoulder radius R of 5 mm, and a die shoulder radius R of 5 mm, and the drawing depth was 25 mm. Measurement of the Vickers hardness (load of 9.8 N, 10 measurements) was also performed at the center of the wall portion of the cup-like body after pressing. In this example, the temperature of the steel sheet reached 850° in nearly 2 minutes.

The appearance after press forming, paint film adhesion, and post-painting corrosion resistance of the hot press formed products obtained in this manner were evaluated in the same manner as in Example 1.

The appearance after press forming was evaluated based on whether a harmful scale of iron oxides was formed. The case in which such scale was formed is indicated by X, and the case in which it was not formed is indicated by ○. It was also determined whether there was any contamination by scattering of a remaining molten zinc layer onto the press die. The case in which there was no contamination is indicted by ○, and the case in which there was contamination of the die are indicated by X.

The above results are compiled in Table 7.

TABLE 7

| Steel No. | C | Si | Mn | P | S | Cu | Ni | Cr | Mo | V | Ti | Nb | Al | B |
|---|---|---|---|---|---|---|---|---|---|---|---|---|---|---|
| 1 | 0.08 | 0.04 | 2.00 | 0.012 | 0.001 | — | — | 0.48 | — | — | — | — | 0.04 | — |
| 2 | 0.10 | 0.05 | 1.13 | 0.021 | 0.005 | — | — | — | — | — | — | — | 0.04 | 0.0001 |
| 3 | 0.12 | 0.02 | 1.51 | 0.010 | 0.002 | — | — | — | — | — | 0.03 | — | 0.04 | 0.0006 |
| 4 | 0.15 | 0.49 | 2.04 | 0.007 | 0.001 | — | — | 0.47 | 0.17 | — | 0.06 | — | 0.04 | 0.0001 |
| 5 | 0.18 | 0.48 | 1.47 | 0.009 | 0.001 | — | — | — | — | — | — | — | 0.02 | 0.0001 |
| 6 | 0.21 | 0.25 | 1.20 | 0.008 | 0.002 | — | — | 0.20 | — | — | 0.02 | — | 0.05 | 0.0007 |
| 7 | 0.27 | 0.11 | 1.50 | 0.001 | 0.001 | — | — | 0.20 | — | — | — | — | 0.03 | 0.0016 |
| 8 | 0.31 | 0.20 | 1.49 | 0.012 | 0.003 | 0.1 | 0.2 | 0.06 | — | 0.03 | 0.01 | 0.03 | 0.02 | 0.0001 |

TABLE 7-continued

| | | | | | | | | | | | | | | |
|---|---|---|---|---|---|---|---|---|---|---|---|---|---|---|
| 9 | 0.33 | 0.11 | 1.53 | 0.001 | 0.001 | — | — | 0.21 | — | — | — | — | 0.04 | 0.0015 |
| 10 | 0.42 | 0.20 | 1.20 | 0.010 | 0.001 | — | — | — | — | — | 0.01 | — | 0.03 | 0.0001 |
| 11 | 0.21 | 0.25 | 1.20 | 0.008 | 0.002 | — | — | 0.20 | — | — | 0.02 | — | 0.05 | 0.0007 |
| 12 | 0.21 | 0.25 | 1.20 | 0.008 | 0.002 | — | — | 0.20 | — | — | 0.02 | — | 0.05 | 0.0007 |
| 13 | 0.21 | 0.25 | 1.20 | 0.008 | 0.002 | — | — | 0.20 | — | — | 0.02 | — | 0.05 | 0.0007 |
| 14 | 0.21 | 0.25 | 1.20 | 0.008 | 0.002 | — | — | 0.20 | — | — | 0.02 | — | 0.05 | 0.0007 |
| 15 | 0.21 | 0.25 | 1.20 | 0.008 | 0.002 | — | — | 0.20 | — | — | 0.02 | — | 0.05 | 0.0007 |

| Steel No. | N | Zn coating weight per side ($g/m^2$) | Fe content of plated layer (%) | Formation of iron oxides (%) | Contamination of die | Adhesion of painted film | Corrosion resistance | Average hardness (Hv) after hot pressing |
|---|---|---|---|---|---|---|---|---|
| 1 | 0.002 | 11 | 30 | ○ | ○ | ○ | ○ | 342 |
| 2 | 0.002 | 31 | 25 | ○ | ○ | ○ | ○ | 361 |
| 3 | 0.003 | 57 | 5 | ○ | ○ | ○ | ○ | 378 |
| 4 | 0.005 | 60 | 20 | ○ | ○ | ○ | ○ | 410 |
| 5 | 0.006 | 89 | 10 | ○ | ○ | ○ | ○ | 431 |
| 6 | 0.005 | 61 | 18 | ○ | ○ | ○ | ○ | 479 |
| 7 | 0.001 | 54 | 10 | ○ | ○ | ○ | ○ | 517 |
| 8 | 0.005 | 52 | 13 | ○ | ○ | ○ | ○ | 557 |
| 9 | 0.001 | 51 | 15 | ○ | ○ | ○ | ○ | 568 |
| 10 | 0.003 | 48 | 20 | ○ | ○ | ○ | ○ | 675 |
| 11 | 0.005 | * | * | X | ○ | X | X | Not determined |
| 12 | 0.005 | 5 | 8 | X | ○ | X | X | |
| 13 | 0.005 | 100 | 13 | ○ | X | X | X | |
| 14 | 0.005 | 59 | 4 | X | ○ | X | X | |
| 15 | 0.005 | 12 | 95 | X | ○ | X | X | |

*No plated layer

Example 7

A molten steel having the composition of Steel No. 6 in Table 7 was prepared in a laboratory and cast into a slab. After the slab was heated at 1200° C. for 30 minutes, it was hot rolled at 900° C. or above to form a steel sheet with a thickness of 3.2 mm. After hot rolling, in order to simulate the process of coiling, each steel sheet was cooled to 550° C. by water spraying, then placed in a furnace and held therein at 550° C. for 30 minutes, and finally cooled to room temperature at a speed of 20° C./hour. After the resulting hot rolled sheet was descaled by pickling, it was cold rolled to reduce its thickness to 1.0 mm. Using a simulator for annealing, a thermal history simulating a continuous hop dip galvanizing line was imparted to each steel sheet. The specific thermal history imparted is shown in FIG. 1 and Table 8. The results of measurement of the Vickers hardness (load of 49 N, 5 measurements) of a cross section of the steel sheet after heat treatment are also shown in Table 8.

The critical cooling speed of each steel was determined as an index of the hardenability of the steel in the following manner.

A cylindrical test piece with a diameter of 3.0 mm and a length of 10 mm which was cut from the hot rolled steel sheet was heated in air to 950° C. at a speed of 100° C./minute, then kept for 5 minutes at that temperature, and cooled to room temperature at various cooling speeds. Then, measurement of the Vickers hardness (load of 49 N, 5 measurements) and observation of the microstructure of the resulting test piece were performed. By measuring the variation of thermal expansion of the test piece during heating and cooling, the $Ac_1$ point and the $Ac_3$ point of the steel were determined.

The faster was the cooling speed from 950° C., the greater was the increase in hardness, but the hardness became substantially constant above a certain cooling speed (that is the critical cooling speed). A nearly single phase martensitic structure was observed with those test pieces the cooling speed of which was equal to or higher than the critical cooling speed.

The critical cooling speed for the steel composition of Steel No. 6 of Table 7 was 17° C./second. The $Ac_1$ point and the $Ac_3$ point of this steel were 728° C. and 823° C., respectively.

Looking at the results of Table 8, when the maximum heating temperature was lower than the $Ac_1$ point, i.e., lower than 728° C., the steel sheet underwent recovery and recrystallization, and its hardness decreased as the temperature increased (Nos. 2-1 and 2-2). The effect of the cooling speed from the maximum heating temperature to the plating bath temperature was small (Nos. 2-9 and 2-10). On the other hand, when the maximum heating temperature was equal to or higher than the $Ac_1$ point, the hardness increased as the cooling speed increased (Nos. 2-3 to 2-8, and 2-11 to 2-16). Furthermore, the hardness increased when the galvanealing temperature was higher than the Ac, point (Nos. 2-18 and 2-20).

When the conditions were in the range according to the present invention, each of the heat treated had a hardness (Hv) of at most 200, and good sheet transportability could be guaranteed.

TABLE 8

| Run No. | Maximum Heating Temp. (° C.) | Cooling Speed (° C./sec) | Galvanealing Temperature (° C.) | Vickers Hardness |
|---|---|---|---|---|
| 2-1 | 650 | 8 | 560 | 198 |
| 2-2 | 700 | 8 | 560 | 187 |
| 2-3 | 740 | 8 | 560 | 179 |
| 2-4 | 760 | 8 | 560 | 177 |
| 2-5 | 780 | 8 | 560 | 165 |
| 2-6 | 800 | 8 | 560 | 164 |
| 2-7 | 820 | 8 | 560 | 154 |
| 2-8 | 840 | 8 | 560 | 158 |
| 2-9 | 650 | 30 | 560 | 197 |

TABLE 8-continued

| Run No. | Maximum Heating Temp. (° C.) | Cooling Speed (° C./sec) | Galvanealing Temperature (° C.) | Vickers Hardness |
|---|---|---|---|---|
| 2-10 | 700 | 30 | 560 | 193 |
| 2-11 | 740 | 30 | 560 | 204 |
| 2-12 | 760 | 30 | 560 | 207 |
| 2-13 | 780 | 30 | 560 | 212 |
| 2-14 | 800 | 30 | 560 | 219 |
| 2-15 | 820 | 30 | 560 | 233 |
| 2-16 | 840 | 30 | 560 | 244 |
| 2-17 | 700 | 8 | 700 | 185 |
| 2-18 | 700 | 8 | 740 | 215 |
| 2-19 | 840 | 8 | 700 | 164 |
| 2-20 | 840 | 8 | 740 | 215 |

INDUSTRIAL APPLICABILITY

According to the present invention, hot press forming of a difficult-to-press form steel material such as a high tensile steel sheet or a stainless steel sheet or a hardenable steel suited for high strength, high hardness products becomes possible. In addition, equipment for controlling the atmosphere of a heating furnace becomes unnecessary, and a step of peeling off oxides on a steel sheet at the time of press forming becomes unnecessary, too. Thus, the manufacturing process for hot press formed products can be simplified. Furthermore, the steel material has a zinc-based plated layer which exhibits a sacrificial corrosion preventing effect, thereby improving the corrosion resistance of the press formed products.

The invention claimed is:

1. A method of forming a galvannealed steel material into a shape by first heating the galvannealed steel material and then hot pressing it, wherein the galvannealed steel material is heated to a temperature of 700 to 1000° C. in the first heating step and a temperature of 700 to 1000° C. is employed for the hot pressing step, wherein the galvannealed steel material comprises of a Fe—Zn alloy layer formed on a surface of a base steel material and an oxide layer comprised of an oxide of zinc being provided on a surface of the Fe—Zn alloy layer, the oxide layer preventing vaporization of zinc during the first heating step of the galvannealed steel material, the oxide layer having a weight of at least 10 mg/m$^2$ of Zn, the oxide layer being present on the surface of the Fe—Zn alloy layer prior to the first heating step.

2. The method of claim 1, wherein the Fe—Zn alloy layer has a Fe content of 5-80% and a coating weight of 10-90 mg/m$^2$ of Zn.

3. The method of claim 1, wherein the base material has a P content of at most 0.015%.

4. The method of claim 1, wherein the base steel material has a Si content of at most 0.5%.

5. The method of claim 1, wherein the base material has a C content of 0.08-0.45%.

6. The method of claim 1, wherein the base steel material contains one or both of Mn and Cr in an amount of 0.5-3.0% in total.

7. The method of claim 1, wherein the base steel material contains 0.0001-0.004% of B.

8. A method for manufacturing a hot pressed steel material comprising the steps of:

preparing a galvannealed steel material having an Fe—Zn alloy layer, an oxide layer comprised of an oxide of zinc being provided on a surface of the Fe—Zn alloy layer, and the oxide layer having a weight of at least 10 mg/m$^2$ of Zn, heating the galvannealed steel material to a temperature of 700-1000° C., applying hot pressing to the resulting heated galvannealed steel material by contacting the heated galvannealed steel material with metallic dies to shape it into a shape of a final product and simultaneously to carry out quenching of the steel material, and removing the shaped and hardened steel material from the dies.

9. The method of claim 8, wherein the galvannealed layer has a Fe content of 5-80% and a coating weight of 10-90 mg/m$^2$ of Zn.

10. The method of claim 8, wherein the base material has a P content of at most 0.015%.

11. The method of claim 8, wherein the base steel material has a Si content of at most 0.5%.

12. The method of claim 8, wherein the base material has a C content of 0.08-0.45%.

13. The method of claim 8, wherein the base steel material contains one or both of Mn and Cr in an amount of 0.5-3.0% in total.

14. The method of claim 8, wherein the base steel material contains 0.0001-0.004% of B.

15. The method of claim 8, wherein the galvannealed steel material is prepared by applying hot-dip plating of zinc to a steel material and heating the resulting hot-dip zinc-plating steel material in an oxidizing atmosphere to perform a surface oxidation of the zinc layer as well as alloying of Zn of the zinc layer with Fe from the base steel material.

16. The method of claim 15, wherein the hot-dip zinc-plating steel material is heated at a temperature of 550 to 650° C.

17. The method of claim 15, wherein the hot-dip plating of steel material is carried out by dipping the steel material into a molten zinc bath containing 0.08~0.4% of Al.

* * * * *

UNITED STATES PATENT AND TRADEMARK OFFICE

CERTIFICATE OF CORRECTION

PATENT NO. : 7,673,485 B2
APPLICATION NO. : 11/186973
DATED : March 9, 2010
INVENTOR(S) : Imai et al.

It is certified that error appears in the above-identified patent and that said Letters Patent is hereby corrected as shown below:

The drawing sheet, consisting of Fig 1 should be deleted to be replaced with drawing sheet, consisting of Fig 1 as shown.

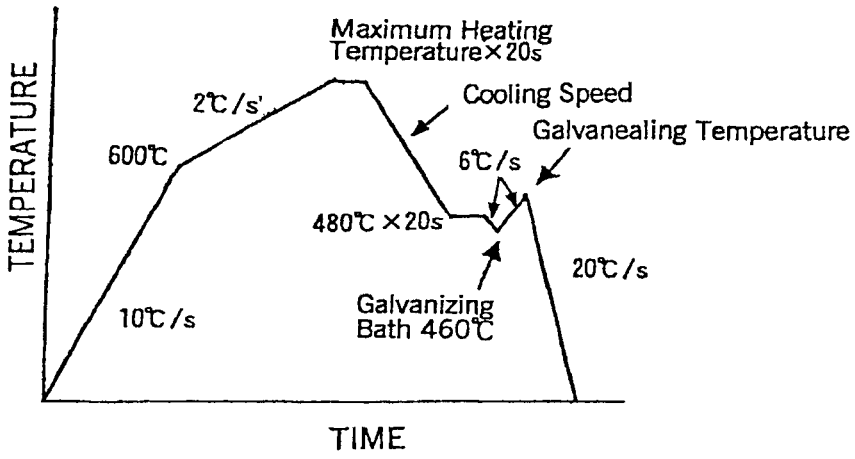

*Fig. 1*

Signed and Sealed this
Fifteenth Day of March, 2011

David J. Kappos

David J. Kappos
*Director of the United States Patent and Trademark Office*